United States Patent [19]

Minton

[11] 4,138,197

[45] Feb. 6, 1979

[54] KEY ACTUATOR

[75] Inventor: Darrell B. Minton, Sebastapol, Calif.

[73] Assignee: National Controls, Inc., Santa Rosa, Calif.

[21] Appl. No.: 818,236

[22] Filed: Jul. 22, 1977

Related U.S. Application Data

[63] Continuation of Ser. No. 643,373, Dec. 22, 1975, abandoned.

[51] Int. Cl.[2] ..... B41J 5/08

[52] U.S. Cl. ..... 400/474; 400/70; 235/146; 200/178; 335/112; 178/17 C; 234/115

[58] Field of Search ..... 197/1.5, 14, 19, 12, 197/13; 200/175, 177, 178; 178/176, 81; 234/111, 112, 114, 115, 116; 335/112; 340/166 S

[56] References Cited

U.S. PATENT DOCUMENTS

| | | | |
|---|---|---|---|
| 1,283,147 | 10/1918 | Ghio | 197/13 |
| 2,070,824 | 2/1937 | Boutet | 235/146 |
| 2,581,665 | 1/1952 | Jarmann | 197/19 |
| 2,644,034 | 6/1953 | Stalbecker | 197/13 |
| 2,718,559 | 9/1955 | Lundkuist et al. | 335/112 |
| 2,737,616 | 3/1956 | Boewer | 197/19 |
| 2,741,669 | 4/1956 | Barrett | 200/178 |
| 2,842,244 | 7/1958 | Gibson | 197/19 |
| 3,029,919 | 4/1962 | Stine | 197/19 |
| 3,249,199 | 5/1966 | Jones, Jr. | 197/19 |
| 3,255,318 | 6/1966 | McKee | 335/112 |
| 3,294,117 | 12/1966 | Eichemeyer et al. | 197/19 |
| 3,507,376 | 4/1970 | Kafafian | 197/19 |
| 3,529,113 | 9/1970 | Vazques et al. | 200/175 |
| 3,629,836 | 12/1971 | Shlesinger, Jr. | 335/112 |
| 3,713,054 | 1/1973 | Elliot | 335/112 |
| 3,856,127 | 12/1974 | Halfon | 197/98 |
| 3,863,044 | 1/1975 | McCormick | 200/175 |

*Primary Examiner*—William Pieprz
*Attorney, Agent, or Firm*—Flehr, Hohbach, Test, Albritton & Herbert

[57] ABSTRACT

Actuator for use with a push-button keyboard in which the keys are arranged in an array of intersecting rows and columns. A single solenoid is provided for each row and column, and means operated by the solenoids causes the key to be depressed at the intersection of a row or column for which the solenoids are energized.

3 Claims, 4 Drawing Figures

KEY ACTUATOR

This is a continuation, of application Ser. No. 643,373 filed Dec. 22, 1975 and now abandoned.

BACKGROUND OF THE INVENTION

This invention pertains generally to keyboard apparatus and more particularly to an actuator for operating the keys of a keyboard in response to electrical signals.

With the advent of computerized equipment such as computing postal scales, the signals produced by such equipment have been utilized to control the operation of other devices such as postage meters, ticket printers and the like. Many existing devices have manually operated keyboards which do not lend themselves to direct control by the electrical signals produced by the computing equipment. In order to permit the use of computing equipment with such devices, there have been some attempts to provide actuators which can be attached to the keyboards to operate the keys in accordance with the signals from the computing equipment.

U.S. Pat. No. 3,507,376 discloses a key actuator for a typewriter or other similar device which requires a separate solenoid for each key to be actuated.

SUMMARY AND OBJECTS OF THE INVENTION

The invention provides an actuator for a keyboard in which the keys are arranged in an array of intersecting rows and columns and a single solenoid is provided for each row and column. Means operated by the solenoids causes a key to be depressed at the intersection of a row and column for which the solenoids are energized.

It is in general an object of the invention to provide a new and improved actuator for selectively depressing the keys of a keyboard.

Another object of the invention is to provide a key actuator of the above character in which the keys are arranged in rows and columns and a single solenoid is provided for each row and column.

Additional objects and features will be apparent from the following description in which the preferred embodiment is set forth in detail in conjunction with the accompanying drawings.

DESCRIPTION OF THE PREFERRED EMBODIMENT

Figure 1:
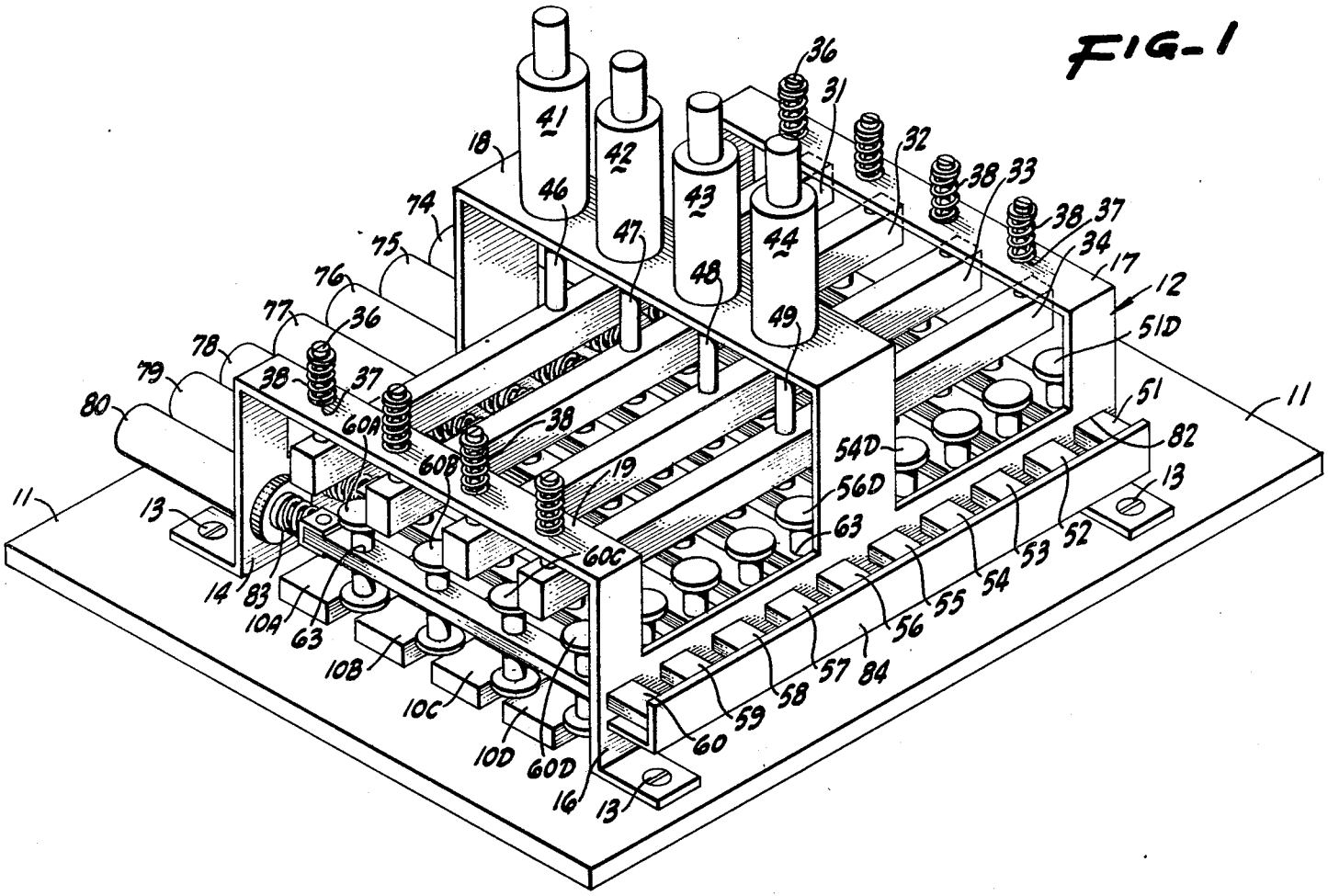
FIG. 1 is an isometric view of one embodiment of a key actuator according to the invention.

In the drawings, the invention is illustrated in connection with a keyboard 11 which can, for example, be the keyboard of a postage metering machine. This key board has a plurality of manually operable push-button keys arranged in a generally rectangular array of rows and columns. The embodiment illustrated has 10 rows designated 1–10, and 4 columns designated A–D. The keys lie at the intersections of the rows and columns and are designated in accordance with the rows and columns in which they lie. Thus, for example, the keys in row 1 are designated 1A–1B, and the keys in row 10 are designated 10A–10B. The invention is not limited to this particular keyboard array, but can be utilized with different numbers of keys arranged in any desired manner.

The actuator includes a supporting framework 12 which is mounted on keyboard 11 and secured thereto by screws 13. The framework includes upstanding side members 14, 16 which extend in a direction generally parallel to the columns of keys and cross members 17–19 which extend between the side members above the keys.

Operating bars 31–34 are mounted on cross members 17, 19 above the keys. The four bars are aligned with columns A–D, respectively, and movable between advanced and retracted positions relative to the keys. The operating bars are supported by screws 36 which extend through openings 37 in the cross members and threadedly engage the bars. Compression springs 38 constrained between the cross members and the heads of the screws urge the operating bars toward their retracted positions.

Means is provided for selectively moving the operating bars to their extended positions. This means includes electrically energized solenoids 41–44 which are mounted on cross member 18 and connected to operating bars 31–34 by connecting rods 46–49, respectively.

A plurality of tappet members are provided for transmitting motion from the operating bars to the keys. One tappet member is provided for each key, and the tappet members are arranged in rows corresponding to the rows of keys. The tappet members are carried by carriers 51–60 which extend transversely of framework 12 and are aligned with rows 1–10, respectively. The tappet members are designated in accordance with their carriers and the columns of the keys which they operate. Thus, for example, the tappet member for key 1A is designated 51A, and the tappet member for key 10C is designated 60C. The tappet members extend freely through openings 63 in the carriers and rest upon the tops of the keys, with the return springs which maintain the keys in their undepressed or rest position also serving to maintain the tappet members in their retracted position. If desired, separate return springs can be provided for returning the tappet members to their rest positions.

Means is provided for moving carriers 51–60 between operating positions in which the tappet members are aligned with the keys and rest positions in which the tappet members are displaced, or offset, from the keys. This means includes a plurality of electrically energized solenoids 71–80 which are mounted on side member 14 of framework 12. The plungers of these solenoids are connected to the carriers at one end thereof, and the remaining ends of the carriers extend through openings 82 in the framework side member 16. Springs 83 urge the carriers toward the rest position, and a stop 84 mounted on side member 16 limits the movement of the carriers to define the rest position.

Figure 2:
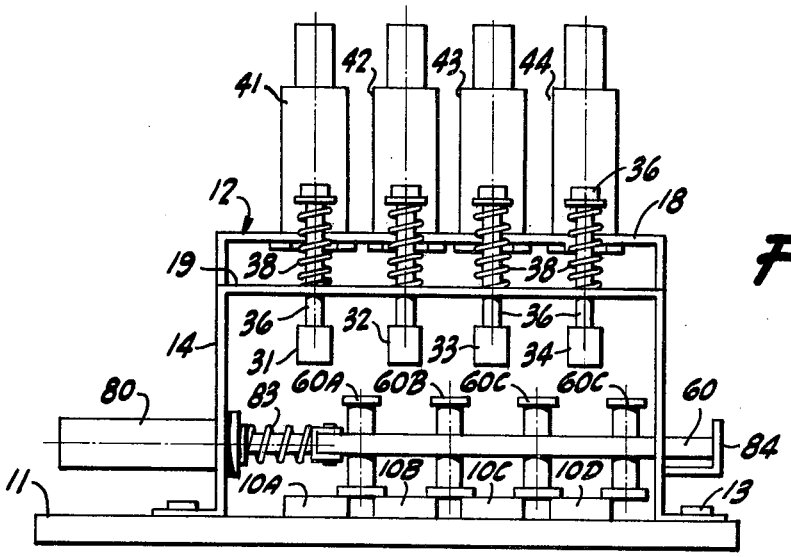
FIG. 2 is a side elevational view of the key actuator of FIG. 1.

Operation and use of the key actuator can now be described. It is assumed that solenoids 41–44 and 71–80 have been connected to a suitable source of control signals for selecting the keys to be depressed. FIG. 2 illustrates the actuator in the rest condition in which all of the solenoids are deenergized, with carriers 51–60 in their rest positions and all of the tappets offset or displaced laterally from the operating bars and keys.

Figure 3:
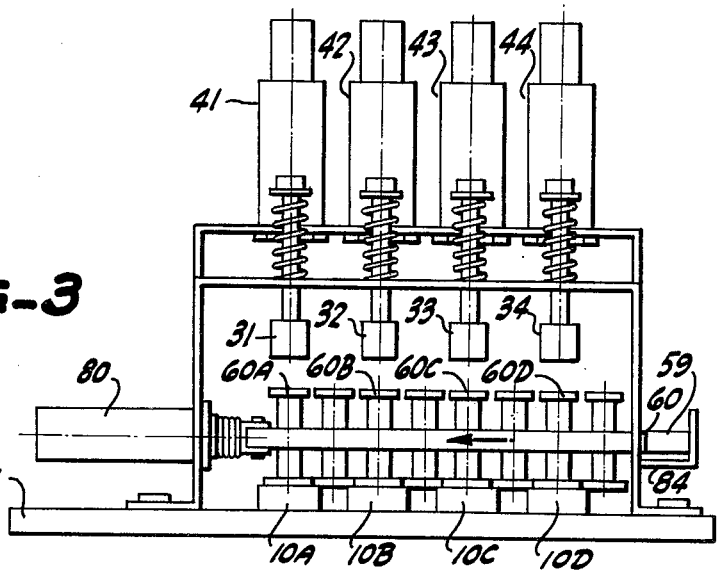
FIGS. 3 and 4 are side elevational views similar to FIG. 2, illustrating the operation of the key actuator.
Figure 4:
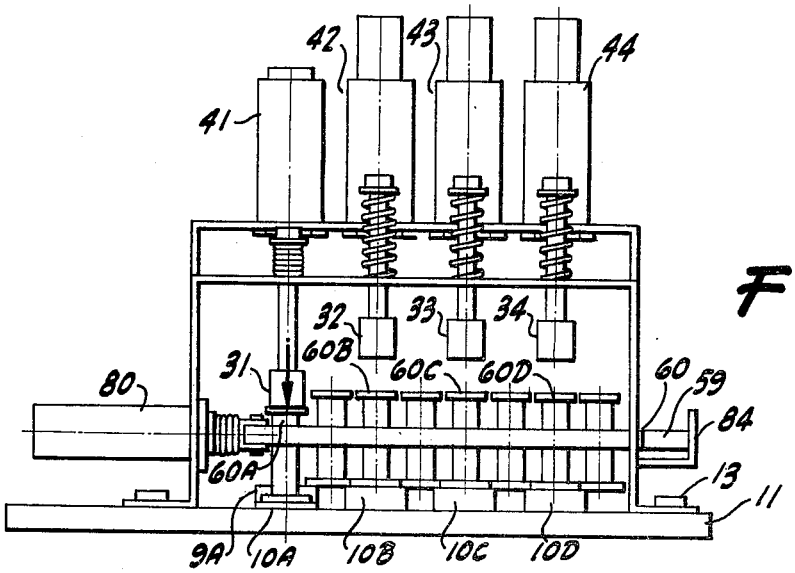

If one of solenoids 71–80 is energized, the carrier connected to that solenoid will be drawn to its operating position and the tappet members carried thereby will be aligned with the operating bars and keys. In FIGS. 3 and 4, it is assumed that solenoid 80 is energized, and carrier 60 is shown in its operating position, with tappet members 60A–60D aligned with operating bars 31–34 and keys 10A–10D, respectively.

With one of the carriers in its operating position, energization of one of the solenoids connected to the operating bars will cause one of the keys to be depressed. In FIG. 4, it is assumed that solenoids 41 and 80 are both energized, and operating bar depresses tappet member 60A to depress key 10A. None of the other keys in column A are depressed, however, since carriers 51–59 are in their rest positions and the tappet members carried thereby are not in position to be engaged by the operating bar. With solenoid 80 energized, energization of solenoid 42 will cause key 10B to be depressed, energization of solenoid 43 will cause key 10C to be depressed, and energization of solenoid 44 will cause key 10D to be depressed. If any of the other carrier solenoids were energized, one of the keys in the row associated therewith would be depressed when one of the solenoids connected to the operating bars was energized.

The invention has a number of important features and advantages. It permits existing devices having manual keyboards to be controlled by electrical signals, and it requires only one solenoid for each row and column of keys.

It is apparent from the foregoing that a new and improved key actuator has been provided. While only the presently preferred embodiment has been described, as will be apparent to those familiar with the art, certain changes and modifications can be made without departing from the scope of the invention as defined by the following claims.

What is claimed is:

1. In apparatus for selectively depressing keys arranged in an array of intersecting rows and columns: an operating bar aligned with each column of keys and movable between advanced and retracted positions relative to the keys, a carrier aligned with each row of keys and movable in a direction parallel to the row, a plurality of key actuating members carried by each carrier and movable between advanced and retracted positions relative to the keys, said actuating members being positioned between the operating bars and the keys for transmitting motion from the operating bars to the keys when aligned therewith, means for slectively moving each of the carriers between a rest position in which the actuating members carried thereby are displaced from the keys and operating bars and an operating position in which the actuating members are aligned with the keys and bars, and means for selectively moving the operating bars to their advanced positions to advance the actuating members and depress the keys aligned therewith.

2. The apparatus of claim 1 wherein the means for moving the operating bars and carriers comprise electrically energized solenoids.

3. In apparatus for selectively depressing keys arranged in an array of intersecting rows and columns: an individually energizable, motion producing mechanical actuator associated with each of the rows and columns, a plurality of tappet members arranged in rows corresponding to the rows of keys and movable axially of the keys between advanced and retracted positions, a carrier for each row of tappet members connected to the actuator associated with the corresponding row of keys and movable between a rest position in which the tappet members are displaced laterally from the keys and an operating position in which the tappet members are aligned with the keys, and an operating bar aligned with each column of keys and connected to the actuators associated with the column for movement between advanced and retracted positions relative to the keys, the operating bars being positioned for engaging the tappet members when said members are aligned with the keys whereby movement of an operating bar serves to move a tappet member engaged thereby to depress the key aligned therewith.

* * * * *